US005469976A

United States Patent [19]

Burchell

[11] Patent Number: 5,469,976

[45] Date of Patent: Nov. 28, 1995

[54] SHELF ALLOCATION AND MANAGEMENT SYSTEM

[76] Inventor: James R. Burchell, 318 New York Ave., Clairton, Pa. 15025

[21] Appl. No.: 55,679

[22] Filed: Apr. 30, 1993

[51] Int. Cl.[6] ..... A47F 5/00

[52] U.S. Cl. ..... 211/59.3; 211/184

[58] Field of Search ..... 211/59.3, 184, 211/51; 312/61, 71

[56] References Cited

U.S. PATENT DOCUMENTS

| | | | |
|---|---|---|---|
| 1,702,987 | 2/1929 | Wilson | 211/59.3 X |
| 2,098,844 | 11/1937 | Waxgiser | 211/59.3 |
| 2,980,259 | 4/1961 | Fowlds | 211/59.3 |
| 3,083,067 | 3/1963 | Vos et al. | 211/59.3 X |
| 4,729,481 | 3/1988 | Hawkinson et al. | 211/59.3 |
| 4,768,659 | 9/1988 | Merl | 211/184 X |

*Primary Examiner*—Robert W. Gibson, Jr.
*Attorney, Agent, or Firm*—Robert L. Potter

[57] ABSTRACT

A shelf allocation and management system for allocating shelf space among rows of products and for moving the rows of products towards the front of the shelf is disclosed. The system includes a plurality of adjacent side rail assemblies positioned along the shelf extending from front to back. Each side rail assembly includes a generally flat base rail and a rigid divider attached to and extended away from the base rail, wherein at least one row of products may be positioned between the dividers of adjacent side rail assemblies. An unbiased backstop assembly is positioned between dividers of adjacent side rail assemblies, wherein the backstop assembly is movable between the front and back of the shelf and is adapted to advance at least one row of products toward the front of the shelf. A rigid puller member positioned between the dividers of adjacent side rail assemblies is associated with the backstop assembly. The puller member is adapted to be manually moved to advance the backstop assembly least towards the front of the shelf, but to leave the backstop assembly undisturbed when the puller member is pushed towards the rear of the shelf. A loader is also disclosed which is adapted to align with the shelf allocation and management system to provide for efficient and rapid restocking of product.

4 Claims, 4 Drawing Sheets

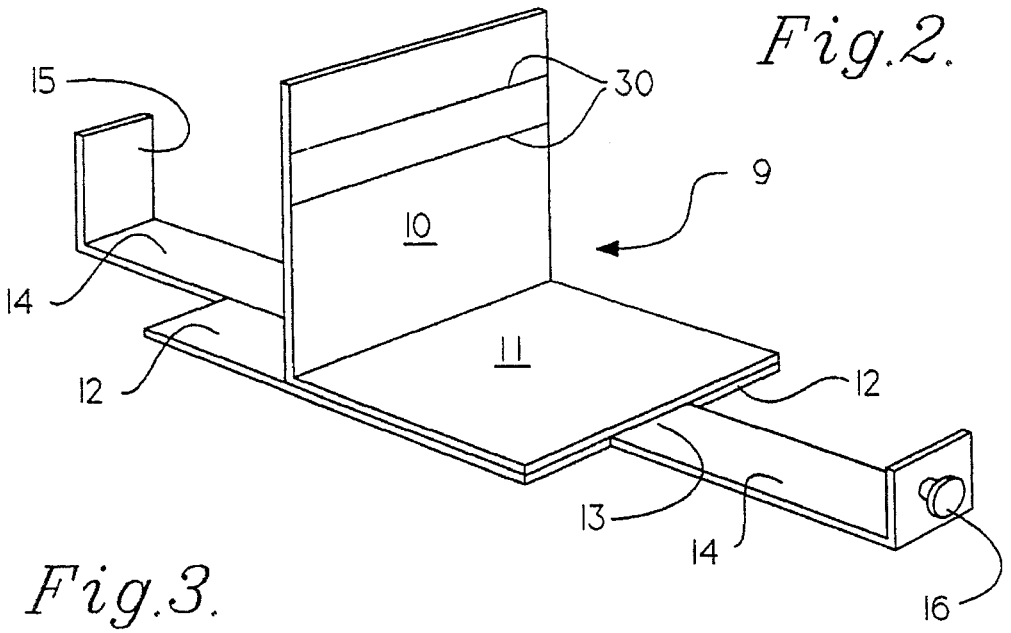
Fig.2.
Fig.3.
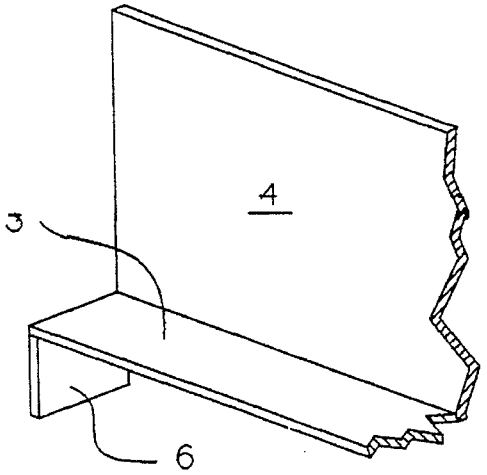
Fig.4.
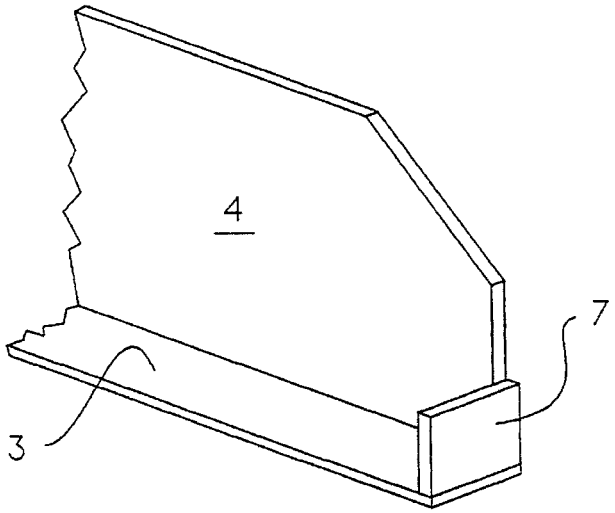

SHELF ALLOCATION AND MANAGEMENT SYSTEM

CROSS-REFERENCE TO RELATED APPLICATION

On or about Feb. 3, 1993, one H. Richard Zuberbuhler filed a patent application for an invention entitled "Shelf Allocation and Management System." In that orginal application, Zuberbuhler claimed that the invention had three co-inventors: himself; James R. Burchell; and David F. Sorosky. In fact, James R. Burchell is the sole inventor of the "Shelf Allocation and Management System" and neither Zuberbuhler nor Sorosky acted as co-inventors with respect to any patentable feature of the "Shelf Allocation and Management System." Applicant James R. Burchell is unaware of the serial no., if any, assigned by the PTO to the application of H. Richard Zuberbuhler.

BACKGROUND OF THE INVENTION

1. Field of the Invention

The invention relates to a system for allocating and managing shelf space among rows of products being offered for sale and for moving those products in rows towards the front of the shelf.

2. Prior Art

In retail stores, particularly but not exclusively grocery stores, products are displayed on shelves for customer inspection and selection. It is essential that the products be organized on the shelves to maximize the use of shelf space. Furthermore, it is necessary to move the products continuously towards the front of the shelf so that customers can inspect the products and select those they desire to purchase. If the product is hidden towards the back of the shelf, or if product is disorganized and displayed chaotically or unattractively, then potential sales may be lost.

There is a prior art which addresses this problem. That prior art, however, involves relatively complex machines which advance products towards the front of the shelf using biasing mechanisms. Those machines are generally limited to a specific size product, are not easily changed in size to adapt to different sized products, and they fail to make maximum use of the store's shelving space.

U.S. Pat. Nos. 4,762,236; 4,830,201; 4,907,707 and 5,012,936 are all examples of the prior art. Those patents disclose complex mechanisms for advancing product rows, using spring-biased backstops which exert a constant pressure on the rearmost product. This constant biasing feature undesirable because many products cannot withstand the constant biasing pressure (such as loaves of broad, types of pasta, bags of fragile foods, such as potato chips, etc.). In addition, the presence of a constant spring-biased force pushing the product forward interferes with restocking of the product as it is exhausted. The person restocking the product must use one hand to defeat the biasing force, and will have only one hand with which to insert restocked product.

U.S. Pat. No. 2,079 754 discloses another complex arrangement which moves products towards the front of the shelf and, on arrival at the front, dispenses the product by pushing the product over the edge of the shelf. This arrangement is necessarily of use only where the storekeeper incorporates the device into a larger dispensing system. The vast majority of storekeepers have no such dispensing system.

These prior art systems are relatively expensive, cannot be used on a wide variety of shelves, do not maximize the amount of shelf space which can be used for products, and are not adaptable to a wide variety of product shapes and sizes.

It is the object of the present invention to overcome the drawbacks of the prior art systems by providing a cost-effective shelf allocation system which is easily manufactured, inexpensive to purchase, quickly and easily adaptable to a wide variety of product shapes and sizes, and which can efficiently advance products towards the front of the shelf for customer inspection and selection. The present invention frees both hands of a restocking clerk because there is no spring-biasing force to defeat. In addition, the application discloses a loader which can be used to restock the shelf allocation and management system efficiently and quickly.

SUMMARY OF THE INVENTION

The present invention achieves the above objects by providing a shelf allocation and management system which allocates shelf space among rows of products and provides for moving the products in rows towards the front of the shelf, all the while minimizing the amount of shelf space occupied by the shelf allocation and management system itself. The shelf allocation and management system of the present invention includes at least two side rail assemblies positioned on the shelf parallel to one another and running from the front to the back of the shelf. Each side rail assembly consists generally of a flat rail base and a rigid divider attached to the rail base and extending upwardly away from the rail base. At least one row of products may be positioned between the dividers of the adjacent side rail assemblies with the products resting on the rail bases. The side rail assemblies are attached only to the shelf, not to one another, and therefore changes in product size and shape can be easily accommodated by moving a side rail assembly from side to side. The side rail assemblies are attached to the shelf using any one of a number of commonly-available fastening systems (double-faced tape; Velcro hook-and-eye fasteners; suction; etc.)

An unbiased backstop assembly is positioned between the dividers of the adjacent side rail assemblies. The backstop assembly is movable between the front and the back of the shelf and is adapted to engage and advance the row of products positioned between the dividers of the adjacent side rail assemblies towards the front of the shelf. A rigid puller member is positioned between the dividers of the adjacent side rail assemblies and engages the backstop assembly. The thickness of the puller member is chosen to be less than the thickness of the rail bases on which the product rests. The puller member is adapted to be manually moved towards the front of the shelf or towards the back of the shelf without being restricted by the weight of the row of products. The puller member passes through the backstop assembly by means of a channel formed into the backstop assembly of sufficient size to provide no restriction to movement of the puller member. When moved towards the front of the shelf, the puller member engages the movable backstop, assembly by a vertical portion of the puller member and causes the backstop assembly to advance product towards the front of the shelf. When moved towards the back of the shelf, the puller member disengages from the movable backstop assembly, leaving the backstop assembly and the row of products at the position to which they have been advanced, thus stowing the puller member.

In other embodiments of the present invention, the backstop assembly is replaced entirely by a horizontal bar member mounted on the rearmost portion of the puller member. In these embodiments, product is advanced towards the front of the shelf by direct action of the puller member on the product row as the puller member is pulled towards the front of the shelf. Rearward movement of the puller member then disengages the puller member from the row of products and stows the puller member.

The puller member can be enhanced with a plurality of grip mechanisms, thus enabling the customer or restocking clerk easily to grasp, pull or push the puller member.

In another embodiment of the invention, a loader can be used to efficiently and quickly restock product into the shelf allocation and management system. The loader is preloaded with product and then aligned through guides with the shelf allocation and management system. The stocking clerk then pushes the product forward, transfering it from the loader to the shelf allocation and management system.

A complete understanding of the present invention will be obtained from the following description when taken in connection with the accompanying drawings wherein like reference numbers identify like parts throughout.

BRIEF DESCRIPTION OF THE DRAWINGS

FIG. 2 is a perspective view of the backstop assembly and puller member.

FIG. 3 is a perspective view showing detail of the use of a hook member at the rear of the side rail assembly.

FIG. 4 a perspective view showing detail of the use of a stop member at the front of the side rail assembly.

DESCRIPTION OF THE PREFERRED EMBODIMENTS

Figure 1:
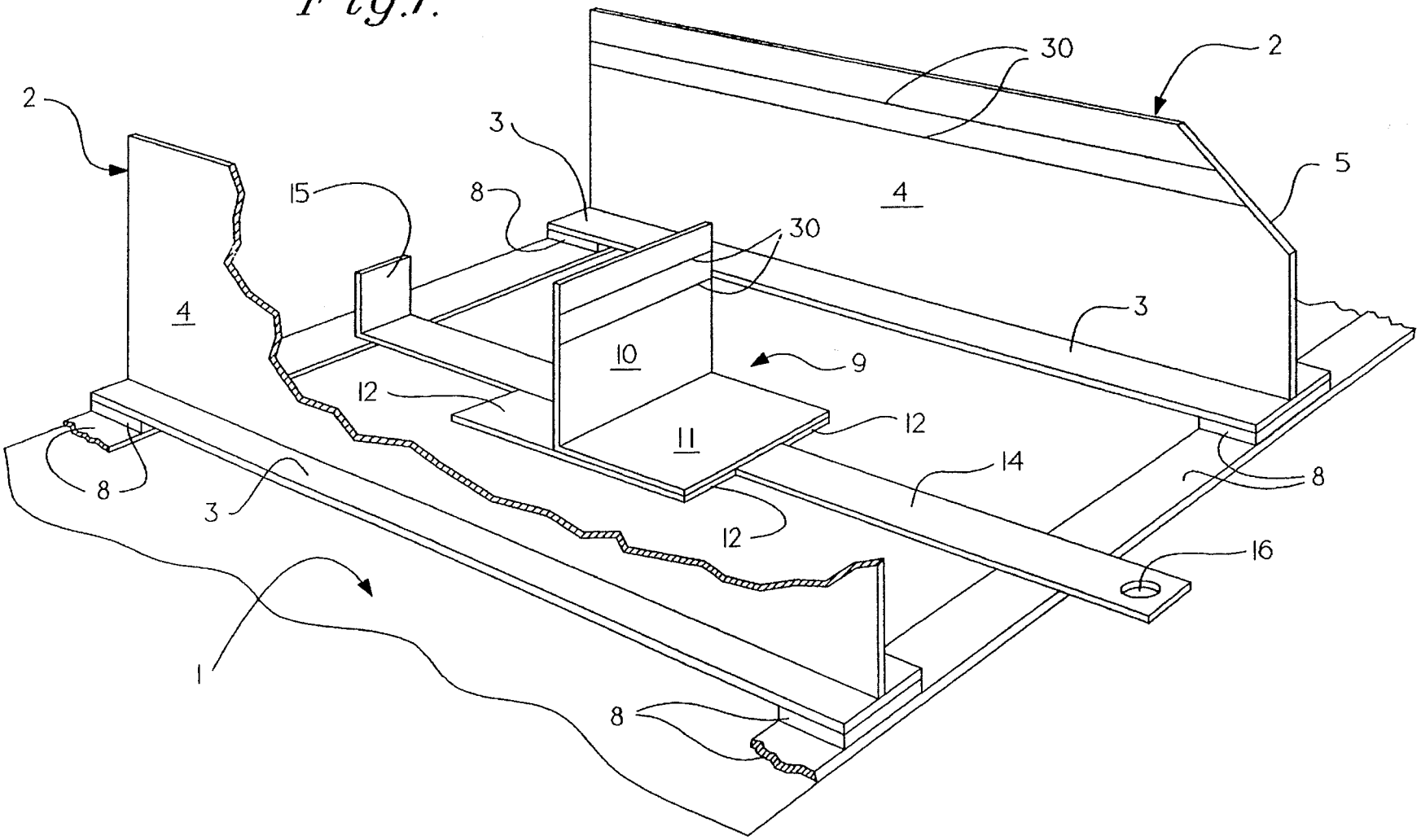
FIG. 1 is a perspective view, partially broken away, of a first embodiment of the shelf allocation and management system in accordance with the present invention.

A shelf allocation and management system according to the first embodiment of the present invention is shown by FIG. 1. The shelf allocation and management system allocates space along a retail store shelf 1 among rows of product 20. The shelf allocation and management system also provides for the movement of the rows of products 20 towards the front of the shelf.

A plurality of side rail assemblies 2 is positioned on the store shelf with each side rail assembly 2 extending from the front of the shelf to the back of the shelf. Each side rail assembly 2 includes a generally flat rail base 3 which is positioned substantially perpendicular to the shelf 1. A rigid thin divider 4 is attached to the rail base 3 and extends upwardly away from the rail base 3. Any number of commonly available manufacturing techniques may be used to join the divider 4 and the rail base 3. The divider 4 forms a minimum-thickness divider between product rows. This minimum-thickness divider between rows allows any individual row of products 20 to be advanced on the shelf independent of any adjacent row of product while maximizing the utilization of the shelf width. The divider 4 additionally prevents product damage from adjacent products.

The front edge 5 of the divider 4 may be tapered toward the front of the shelf. This construction permits easier viewing of the product 20 in that row and decreases the obstruction when viewing an entire product row.

The side rail assemblies 2 may be removably attached at appropriate positions on the shelf. Various connecting materials 8 may be utilized for non-permanently attaching the side rail assemblies 2 to the shelf 1, such as, for example, double faced tape, hook-and-loop and hook-to-hook type fasteners such as Velcro, or non-permanent adhesives. FIG. 1 illustrates two stripes of connecting material 8 which extend longitudinally along the length of the shelf and the front and the back thereof. Shorter sections of corresponding connecting material 8 are attached to the bottom surface of the rail base 3. The two strips of connecting material 8 may be reinforced with a plastic support strip (not shown) for bridging wire shelving or other types of non-solid shelving. Adhesive may be provided on the bottom of the support strip to adhere the support strip to the shelf. The connecting material 8 and the corresponding connecting material 8 may be formed of a variety of fastening materials, such as double-faced tape, hook-and-eye fasteners, or non-permanent adhesives. With this arrangement, when the products 20 are nesting on the rail bases 3, the connecting materials prevent any lateral displacement of the side rail assemblies 2. The connecting materials should be selected to enable easy removal and repositioning of the side rail assemblies 2 when the products 20 have been removed.

A backstop assembly 9 is positioned between the dividers 4 of adjacent side rail assemblies 2. The backstop assembly 9 is movable between the front and the back of the shelf 1 and is adapted to engage and advance a row of products 20 positioned between adjacent side rail assemblies 2 toward the front of the shelf 1.

FIG. 2 illustrates the construction of the backstop assembly 9 and its relationship to the puller member 14. A single rectangular piece of material of appropriate size is bent to an angle which may be but need not be ninety degrees, thereby forming the backstop plate 10 and the backstop base 11. Two pieces of rectangular material of appropriate size described as the backstop base channel pieces 12 are then attached to the bottom of the backstop base 11, leaving a space between them and under the backstop base to serve as a channel 13 to accommodate the puller member 14. The puller member 14 is appropriately sized so as to move backwards and forwards through the channel 13 without restriction. There is a backstop engaging portion 15 at the rearmost part of the puller member 14 which engages the product 20 when the puller member 14 is pulled towards the front of the shelf 1. A variety of gripping elements 16 may be attached to the front of the puller member 14. This gripping element may be fashioned variously, including a simple hole, as shown in FIG. 1, a knob, or an upturned portion of the puller member 14 as shown in FIG. 2, convenient for grasping with the fingers.

FIGS. 3 and 4 illustrate that a stop member 7 may be attached to the front of the rail base 3, thereby providing a physical stop against forward movement of product 20 towards the front of the shelf. A hook member 6 may be attached to the back of the rail base 3, said hook member extending below the shelf 1 at its back edge, thereby providing a physical restriction against forward movement of the side rail assembly 2 forward on the shelf. The hook member 6 will be particularly useful when the shelf allocation and management system is placed on a sloping shelf.

Figure 5:
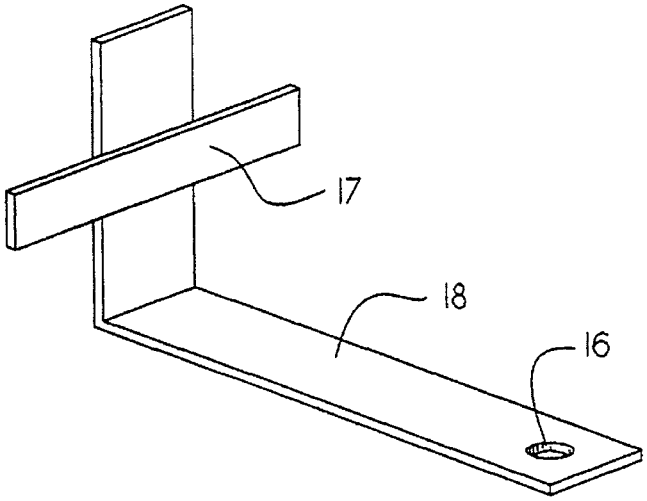
FIGS. 5 and 6 show alternative embodiments of the puller member in which no backstop assembly is used and the puller member acts directly against the product.
Figure 6:
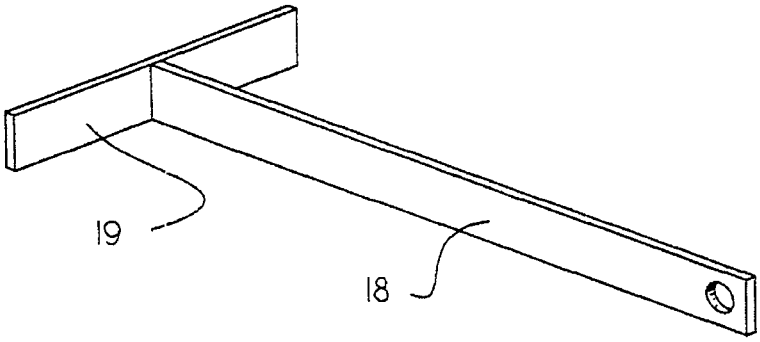

As illustrated by FIGS. 5 and 6, other embodiments of the puller member are possible. In FIG. 5, the backstop assembly 9 is not used. Rather, a horizontal puller member 17 is attached to the vertical portion of the puller member 15. In this embodiment, the product 20 is advanced towards the shelf front by direct action of the puller member. In FIG. 6, the puller member 18 is vertical, not horizontal, and a product advancing bar 19 is attached perpendicular to the vertical puller member 18. This embodiment is particularly useful in simultaneously advancing two rows of product 20 within a single shelf allocation and management system, a row on each side of the vertical puller member 18.

Figure 7:
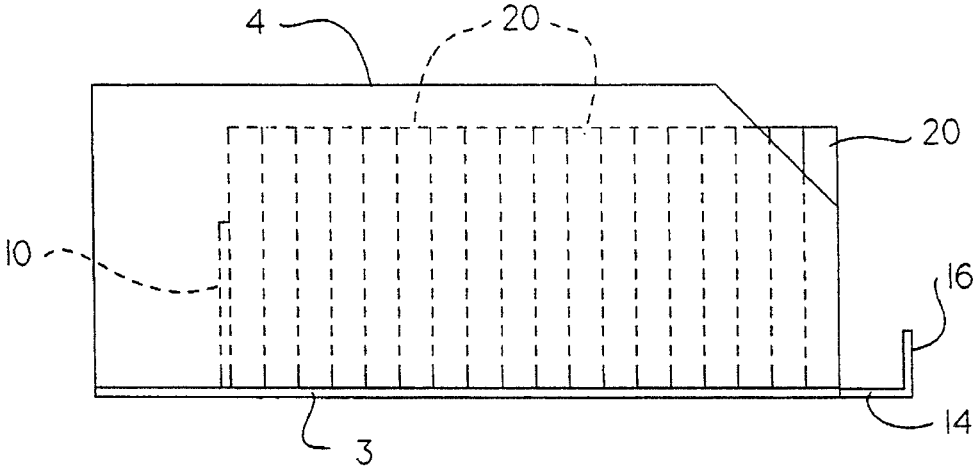
FIG. 7 is a side elevation view of the shelf allocation and management system, with a row of product packages shown in phantom.

As illustrated in FIG. 7, the products 20 are positioned between dividers 4 of adjacent side rail assemblies 2 and are supported on the base rails 3 of the adjacent side rail assemblies 2. Supporting the products 20 on the base rails 3 lifts the products 20 off the shelf. This provides a greater degree of airflow underneath the products 20 and provides a significant advantage for products stored in a freezer. In a freezer environment, the increased airflow around the product 20 will maintain a more uniform temperature within the product.

Figure 8:
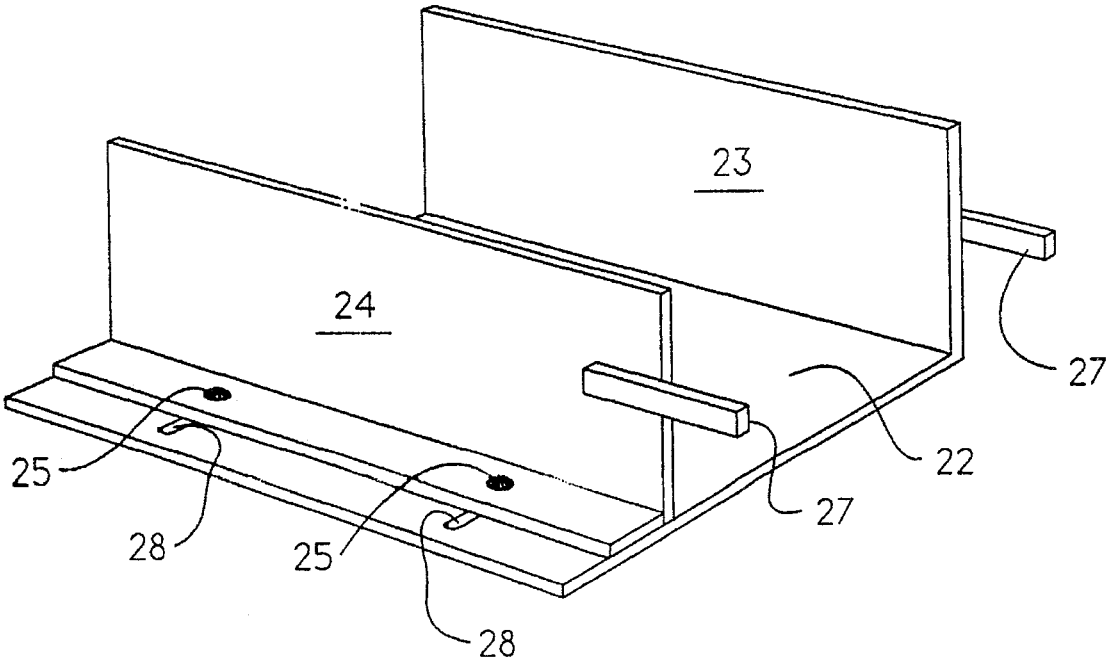
FIG. 8 is a perspective view of the loader.
Figure 9:
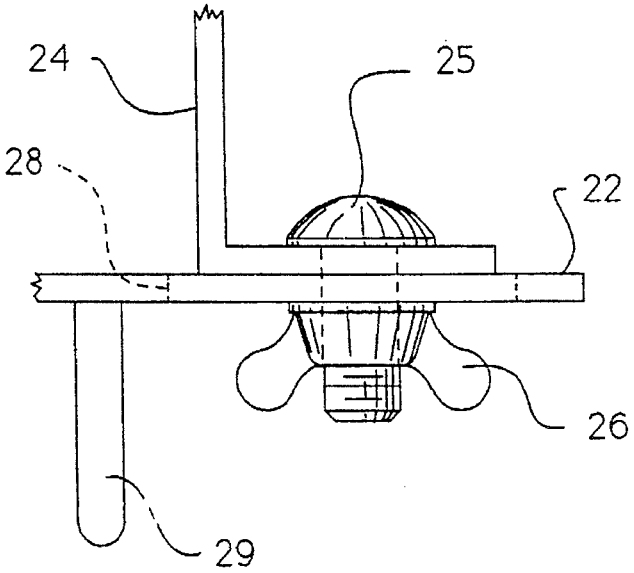
FIG. 9 is a sectional view which shows the manner in which the movable side member of the loader is attached to the loader base with bolts and wing nuts.

FIG. 8 illustrates a loader device which can be used to restock product 20 onto the shelf allocation and management system. A fixed side member 23 is mounted perpendicular to the loader base 22. A movable side member 24 is mounted also perpendicular to the loader base 22, but is held in place by bolts 25 and finger-tightened wing nuts 26. As shown by FIG. 9, the bolts 25 are placed in slots 28 cut into the loader base 22, thereby enabling the movable side member 24 to be placed at a variety of positions and temporarily fixed in place by tightenening the wings nuts 26. A handle 29 is attached to the bottom of the loader base 22, thereby enabling a restocking clerk to maneuver the loader with one hand. FIG. 9 shows detail of the manner in which the bolts 25 and wing nuts 26 are used to make the movable side member 24 adjustable in relation to the loader base 22. Guides 27 extend from the front of the loader and are used to bring the loader into alignment with the shelf allocation and management system. The restocking clerk then pulls the puller member 14 onto the loader, drawing the backstop assembly 9 to the very front of the shelf. With his free hand, the restocking clerk can then push the product from the loader onto the shelf, causing the backstop assembly 9 to retreat to the back of the shelf with a new row of product 20 to dispense.

The shelf allocation and management system operates as follows. The products 20 are positioned in a row between the dividers 4 of adjacent side rail assemblies 2. The products 20 are supported by the rail bases 3. As the products 20 are removed from the row, the store customer or stock person will advance the row of products 20 towards the front of the shelf by moving the puller member 14 towards the front of the shelf. As the puller member 14 is advanced towards the front of the shelf, the backstop engaging portion 15 of the puller member 14 engages the backstop assembly 9 and advances the row of products towards the front of the shelf. Once this has been accomplished, the customer or stock person may then push the puller member 14 towards the back of the shelf. Because the puller member 14 is only slideably related to the backstop assembly 9 through the channel 13, in its backwards movement the puller member 14 will experience no resistance from either the backstop assembly 9 or from the products 20. Thus, the puller member 14 may be pushed backwards without disturbing the backstop assembly 9 or the products 20 until the puller member 14 is conveniently stowed. This process may be repeated as often as needed until the row of products 20 is exhausted. When the row of products 20 has been exhausted or when restocking is necessary, the backstop assembly 9 can be manually pushed back toward the back of the shelf and new products inserted. Or, the loader, as depicted in FIG. 8, may be used to restock the product in the manner already described.

Additionally, as shown in FIG. 1, score marks 30 may be provided on the rigid dividers 4 and in the backstop plate 10 of the backstop assembly 9, respectively. These scores marks allow for a portion of the rigid divider 4 or the backstop plate 10 to be broken off so that the height of the divider 4 and the backstop plate 10 can be adjusted as appropriate for the shape and size of the product in the row of products 20. This configuration allows one mold or manufacturing technique to product a variety of heights of side rail assemblies 2 and backstop plates 10. Furthermore, markings may be provided on the puller member 14 to indicate the space remaining on the shelf when the products 20 are advanced to the front as an aid for restocking or inventory purposes.

Specific embodiments of the present invention have been described in detail herein, and it will be appreciated by those skilled in the art that various modifications and alternatives to the embodiments could be developed in light of the overall technique of the disclosure. For example, many features of specific detailed embodiments described above could be incorporated into the other disclosed embodiments such as, for example, the gripping element 16, the hook 6, and the stop member 7. Accordingly, the particular arrangements are illustrative only and are not limiting as to the scope of the present invention which is to be given the full breadth of the appended claims and any and all equivalents thereof.

What is claimed is:

1. A shelf allocation management system for allocating shelf space among rows of products and for moving the rows of products towards the front of the shelf, said shelf allocation and management system comprising:

(a) at least two adjacent side rail assemblies positioned on the shelf extending from the front of the shelf to the back of the shelf, each said side rail assembly including a generally flat base rail and a rigid divider attached to and extending upwardly from said base rail, wherein at least one row of product may be positioned between said adjacent side rail assemblies, each side rail assembly being removably attached at appropriate positions on the shelf so as to facilitate adjustment of the distance between the said side rail assemblies to accommodate products of varying dimensions;

(b) an unbiased backstop assembly positioned between said dividers of said adjacent side rail assemblies, said backstop assembly moveable between the front and back of the shelf and adapted to engage and advance at least one row of products which may be positioned between said dividers of said adjacent side rail assemblies towards the front of the shelf; said backstop assembly to include a channel adapted to slideably receive a puller member; and (c) a rigid puller member positioned between said dividers of said adjacent side rail assemblies and associated with said backstop assembly, said puller member adapted to be manually moved towards the front and the back of the shelf to move said backstop assembly towards the front of the shelf, said puller member extending through the channel in the backstop assembly such that when said puller member is advanced towards the front of the shelf it simultaneously advances the backstop assembly towards the front of the shelf, but such that the puller member, when pushed towards the back of the shelf, does not disturb the position of the backstop assembly and leaves the backstop assembly in contact with at least one row of product.

2. A shelf allocation management system for allocating shelf space among rows of products and for moving the rows of products towards the front of the shelf, said shelf allocation and management system comprising:

(a) at least two adjacent side rail assemblies positioned on the shelf extending from the front of the shelf to the back of the shelf, each said side rail assembly including a generally flat base rail and a rigid divider attached to and extending upwardly from said base rail, wherein at least one row of products may be positioned between said adjacent side rail assemblies, each side rail assembly being removably attached at appropriate positions on the shelf so as to facilitate adjustment of the distance between the said side rail assemblies to accommodate products of varying dimensions;

(b) an unbiased backstop assembly positioned between said dividers of said adjacent side rail assemblies, said backstop assembly moveable between the front and back of the shelf and adapted to engage and advance at least one row of products which may be positioned between said dividers of said adjacent side rail assemblies towards the front of the shelf;

(c) a rigid puller member positioned between said dividers of said adjacent side rail assemblies and associated with said backstop assembly, said puller member adapted to be manually moved towards the front and the back of the shelf to move said backstop assembly towards the front of the shelf; and (d) a loader which enables a restocking clerk to transfer product from the loader directly to the shelf allocation and management system with a single forward push against the product.

3. The shelf allocation and management system of claim 2 wherein said backstop assembly includes a channel adapted to slideably receive said puller member.

4. The shelf allocation and management system of claim 3 wherein said puller member extends through said channel and includes a backstop plate engaging portion which is adapted to be abutted against the backstop plate to move said backstop assembly by said manual movement of said puller member.

* * * * *